United States Patent [19]

Gorman et al.

[11] 4,149,050

[45] Apr. 10, 1979

[54] CUP-SHAPED CONTACTS FOR VACUUM INTERRUPTERS HAVING A CONTINUOUS ANNULAR CONTACT SURFACE

[75] Inventors: Joseph G. Gorman, Murrysville; Richard L. Hundstad, Wilkinsburg; Roy E. Voshall, New Alexandria, all of Pa.; Paul O. Wayland, Montour Falls, N.Y.

[73] Assignee: Westinghouse Electric Corp., Pittsburgh, Pa.

[21] Appl. No.: 785,382

[22] Filed: Apr. 7, 1977

Related U.S. Application Data

[63] Continuation of Ser. No. 540,206, Jan. 10, 1975, abandoned.

[51] Int. Cl.[2] ..... H01H 33/66

[52] U.S. Cl. ..... 200/144 B

[58] Field of Search ..... 200/144 B

[56] References Cited

U.S. PATENT DOCUMENTS 3,836,740 9/1974 Hundstad ..... 200/144 B

FOREIGN PATENT DOCUMENTS 1765263 9/1971 Fed. Rep. of Germany ..... 200/144 B 997384 7/1965 United Kingdom ..... 200/144 B

*Primary Examiner*—Robert S. Macon

*Attorney, Agent, or Firm*—W. G. Sutcliff

[57] ABSTRACT

A vacuum circuit interrupter contact being generally cup-shaped with a radially inward extending lip with slots formed through the lip and side wall for directing current flow and including a flat annular contact cap attached directly to the lip portion. The annular contact cap extends from the side walls radially inward to a position inside of the lip-shaped portion. At the inner diameter of the annular contact cap an arcing ring is formed which extends downward along the inner diameter of the lip portion. The annular contact cap can be formed from a material having good arc interrupting properties, such as chromium copper, while the rest of the contact can be formed from a material which is easy to fabricate and has good electrical conductivity properties, such as copper. In another embodiment of the invention, the lip portion and the annular contact cap are formed as one member but any slots formed in the lip-shaped portion do not extend to the contact making surface. Thus the contact making surface is still in a continuous annular contact area. The contact structure is shaped so that when an arc is formed during circuit interruption the arc is moved radially inward and around the arcing rings of the pair of contacts. The disclosed contacts provide high current interrupting ability with little arc-seasoning.

5 Claims, 4 Drawing Figures

CUP-SHAPED CONTACTS FOR VACUUM INTERRUPTERS HAVING A CONTINUOUS ANNULAR CONTACT SURFACE

This is a continuation of application Ser. No. 540,206 filed Jan. 10, 1975, now abandoned.

BACKGROUND OF THE INVENTION

1. Field of the Invention

The present invention relates to vacuum type circuit interrupters and more particularly to a contact structure used in such vacuum interrupters.

2. Description of the Prior Art

In a vacuum interrupter the current normally flows through a pair of contacts located in an evacuated envelope. These contacts are relatively movable between a closed position in engagement and an open position spaced apart to interrupt the current flow through the vacuum interrupter. As the contacts are separated an arc is formed therebetween and current will continue to flow until this arc is extinguished, which on an alternating current circuit will normally occur near the first current zero. The contact surface must support the arc from its initiation at the time of contact separation until its extinction at approximately current zero. While the arc is being sustained the contacts are subjected to very intense localized heating. The dissipated arc energy causes melting, erosion and general deterioration of the contact surfaces. To minimize deterioration of the contact surfaces, it is customary to move the arc around the contact surface. Such arc movement tends to minimize the amount of metallic vapors or particles generated by the arc from the contact surfaces during circuit interruption. This arc movement is usually accomplished by self-induced magnetic fields as more fully explained in prior art U.S. Pat. No. 3,089,936 issued May 14, 1963 to S. R. Smith, Jr. and U.S. Pat. No. 3,417,216 issued Dec. 17, 1968 to S. R. Smith, Jr.

French Pat. No. 1,410,884 shows a cup-shaped contact with an inward facing lip. This contact however, does not have a large continuous contact making surface, as disclosed in the instant application, and thus would have the problems as discussed for U.S. Pat. No. 3,836,740. British Pat. No. 997,384 discloses a cup-shaped contact having slotted side walls wherein the slots do not extend to the contact surface. This contact however, does not have the inward facing lip portion, which is necessary for large current interrupting ability. Also British Pat. No. 997,384 does not teach that the contact surface and the main contact body can be made of different material which in some applications is very important.

In U.S. Pat. No. 3,836,740 a contact construction is disclosed wherein a cup-shaped contact with an inwardly facing lip is provided. The lip portion and the side walls are slotted, thus moving an arc formed during circuit interruption radially inward and circumferentially around the contact surface formed by the lip portion. Specific advantages and construction of this contact are more fully disclosed in copending U.S. Pat. No. 3,836,740. An unobvious problem with this construction is that a large amount of arc-seasoning is required to bring the interrupting ability of this contact to its full potential. This large amount of preconditioning restricts the use of this contact construction in commercial apparatus.

SUMMARY OF THE INVENTION

According to the teaching of the present invention an improvement in the construction of a cup-shaped contact is disclosed. The beneficial result of this improvement is to provide a vacuum interrupter, fresh from the factory that will exhibit a high current interruption capability and possess a large voltage withstand capability without the necessity of subjecting the interrupter to a lengthy break-in or arc-seasoning procedure.

A problem that has been discovered with prior art contacts having a cup-shape and providing arc rotation is that they require a long series of arc-seasoning operations to produce a superior level performance. The disclosed invention provides a construction that eliminates this required arc-seasoning procedure. This makes a vacuum interrupter utilizing the disclosed construction commercially feasible. The resulting vacuum interrupter has a superior current interrupting capability. Prior art cup-shaped contacts have normally been used at moderate currents such as 25 kA or less, with voltages on the order of 15 kV or less. With the disclosed contact construction currents up to 50 kA and voltages up to 38 kV are possible with relatively small size vacuum interrupter enclosures.

A vacuum type circuit interrupter is provided wherein a pair of relatively movable contacts are disposed in an evacuated envelope. An operator is provided for moving the contacts between a closed position, completing an electrical circuit through the vacuum interrupter, and an open position, wherein the contacts are separated and an arcing gap is formed therebetween. An arc if formed in the arcing gap during a normal interrupting operation of the vacuum type circuit interrupter. The disclosed contacts are of a generally cup-shaped configuration having a radially inward extending lip portion formed at the free end of the side walls. Slots are formed, in the lip portion and the side walls, to direct the current flow as desired. The slots, in the lip portion and in the side walls, cause the current to flow in a manner to create magnetic forces that cause the arc to move around the contact. An annular continuous cap of appropriate contact material is electrically connected directly to the lip portion. Both mating contacts can have a similar contact construction. Thus, arcing will take place between the smooth annular surfaces and the arc will not have to jump across gaps in the contact surface. The smooth contact surface also prevents the arc from becoming hung-up on sharp edges or point locations in a manner so as to produce unwanted anode spots. The annular cap extends radially inward from the outer diameter of the side walls to position inside of the lip portion. The thickness of the annular cap is made small relative to the thickness of the cup rim or lip so that the current flow pattern in the various segments of the lip and side wall are not substantially effected by the presence of the cap. Keeping the cap thin provides the desired magnetic forces for the beneficial arc motion yet thick enough to withstand the erosion that may occur during the normal life of the interrupter. A smooth round arcing ring is formed at the inner diameter of the annular contact cap. This arcing ring extends downward across the inner diameter of the lip portion. The annular contact cap can be formed from a material having good arc interrupting properties, such as chromium copper while the rest of the contact can be formed from material having good current conductivity properties, such as copper.

In another embodiment of the invention, the annular cap and lip are formed from one piece. This can be accomplished by having slots cut in the rim and annular contact surface and then closing them over by a mechanical operation such as peening the contact surface and then fusing it over by the application of intense localized heating supplied from any of a varity of sources, such as arc welding type apparatus, high power electron beam, high power laser beams, or the like. The result is a formed contact having a side wall portion and a lip portion with slots through the side wall portion and partially through the lip portion, but providing a smooth annular contact surface. The unobvious and unexpected results obtained by constructing a contact in the manner described are increased current interrupting capabilities, and operation at higher withstand voltages. These advantages can be obtained without long arc-seasoning as is required in prior art cup-shaped contacts.

It is an object of this invention to disclose a contact construction of a cup-shaped contact having an inwardly facing lip portion utilizing slots for directing current flow while requiring little or no arc-seasoning before providing a high arc interrupting capability.

It is a further object of this invention to disclose a cup-shaped contact with a reentrant lip portion having an annular smooth continuous contact cap applied to the lip portion. To facilitate construction the annular contact cap and the rest of the contact can be of different materials.

BRIEF DESCRIPTION OF THE DRAWINGS

For a butter understanding of the invention, reference may be had to the preferred embodiment exemplary of the invention shown in the accompanying drawings, in which.

DESCRIPTION OF THE PREFERRED EMBODIMENT

Figure 1:
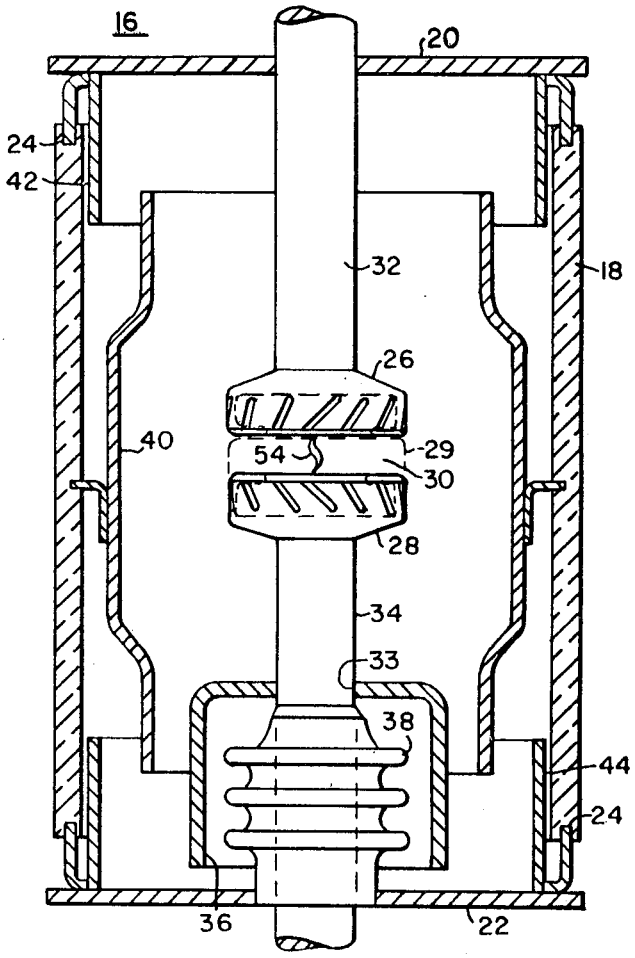
FIG. 1 is a vacuum interrupter utilizing the teaching of the present invention.

Referring now to the drawings and FIG. 1 in particular, there is shown a vacuum type circuit interrupter 16 utilizing the teaching of the present invention. The vacuum type circuit interrupter 16 comprises a highly evacuated tubular insulating envelope 18, formed from glass or suitable ceramic material, and a pair of metallic end caps 20 and 22, closing off the end of the insulating envelope 18. Suitable seals 24 are provided between the end caps 20 and 22 and insulating envelope 18 to render the inside of the insulating envelope 18 vacuum tight. The pressure within the envelope 18 under normal operating conditions is lower than $10^{-4}$ torr to insure that the mean free path for electron travel will be longer than the potential break down path within the envelope 18. Located within the insulating envelope 18 are a pair of relatively movable electrodes or contacts 26 and 28, shown in FIG. 1 in their open circuit position. When the contacts 26 and 28 are separated there is formed an arcing gap 30 therebetween. The upper contact 26 is stationary, and is secured to a conducting rod 32 by suitable means, such as welding or brazing. The conducting rod 32 is rigidly joined to the stationary end cap 20 by a suitable means, such as welding or brazing. The lower contact 28 is movable and is joined to a conductive operating rod 34 by a suitable means such as welding or brazing. The operating rod 34 is suitably mounted for movement along the longitudinal axis of the insulating envelope 18. The operating rod 34 projects through an opening 33 in the bellows end cap 36 as shown in FIG. 1. A metal bellows 38 is secured in sealing relationship at its respective opposite ends to the operating rod 34 and to the opening 33 through bellows end cap 36. The flexible metallic bellows 38 provides a seal about the operating rod 34 to allow for movement of the operating rod 34 without impairing the vacuum within the insulating envelope 18.

Coupled to the lower end of the operating rod 34 is a suitable actuating means (not shown) for driving the movable contact 28 upward into engagement with the stationary contact 26 so as to close the interrupter 16. The close position of the movable contact 28 is indicated by the phantom lines 29. The actuating means is also capable of returning the movable contact 28 to its open position during circuit interruption.

When the contacts 26 and 28 are separated during circuit interruption, an arc 54 is formed at the arcing gap 30 between the contacts 26 and 28. The arc 54 which is formed between the contacts 26 and 28 vaporizes some of the contact material and these vapors and particles are dispersed from the arcing gap 30 toward the insulating envelope 18. The internal insulating surfaces of the insulating envelope 18 are protected from the condensation of the arc generated metallic vapors and particles by means of a tubular metallic shield 40 which is suitably supported. Shield 40 acts to intercept and to condense arc generated metallic vapors and particles before they can reach the insulating envelope 18. To further reduce the chances for metallic vapors or particles reaching the insulating envelope 18, by bypassing the shield 40, a pair of end shields 42 and 44 are provided at opposite ends of the main central shield 40. The speed with which the vapors, generated during arcing, are removed determines the steady state operating condition during arcing and also the recovery capability of the vacuum interrupter 16. If the vapors are not quickly removed, high voltage transients may cause the arc to reignite, after it has been extinguished, resulting in falure of the interrupter 16. The arc 54 by inneracting with the main shield 40 and melting a hole therethrough, is the cause of many failures noted in prior art vacuum interrupters 16.

Figure 2:
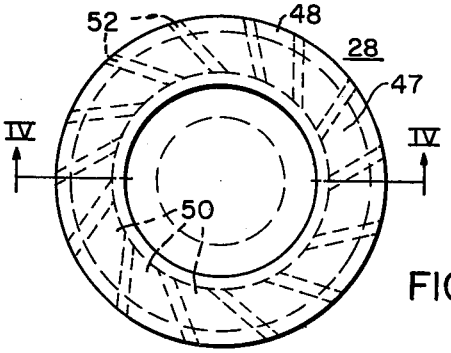
FIG. 2 is a detailed top view of a contact constructed in accordance with the teaching of the present invention.
Figure 3:
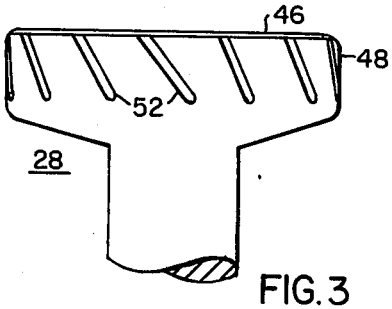
FIG. 3 is a side view of the contact shown in FIG. 2.
Figure 4:
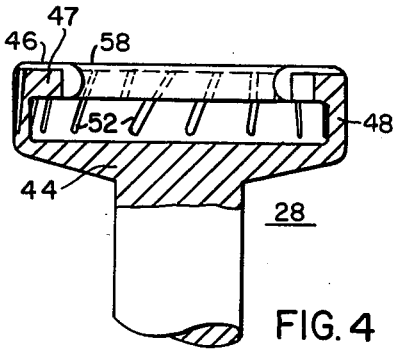
FIG. 4 is a section view of the contact shown in FIG. 2 along the line IV—IV.

Referring now to FIGS. 2, 3 and 4 there is shown a contact structure 28 embodying the teaching of the present invention. Contact 28 comprises a cup-shaped contact, with a flat round base portion 44, from which side walls 48 extend. Contact 28 is generally cup-shaped with an inward facing lip portion 47 to which is connected an annular contact cap 46. The annular contact surface of cap 46 lies in a plane which is perpendicular to the sides or wall 48 of the cup-shaped contact 28. The lip portion 47 is divided into a plurality of surfaces 50. The surfaces 50 are formed by cutting slots 52 through the inward facing lip 47 and the wall 48 of the cup-shaped contact 28. The slots 52 made into contact 28 are angled so as to make the surfaces 50 point in a somewhat circumferential or azmuthial direction. The thickness of the annular cap 46 is made relatively thin compared with the thickness of the lip portion 47 so that the magnetic forces generated by the current flow through the portion 50 are not substantially effected by the cap 46. Thus any arc 54, as shown in FIG. 1, which is formed when the contacts 26 and 28 are separated during current interruption is driven in a combined axmuthial (circumferential) and radially inward direction. This tends to confine the arc 54 to the inner electrode or arcing gaps space 30 and thereby prevents the arc 54 from interacting with the are shield 40.

The angles of the slots 52 cut into cup-shaped contact 28 and the amount by which the annular lip portion 47 and the annular cap 46 extend radially inward can be used to establish the angular velocity and the radial position of the arc 54. Thus, if the slots 52 in contact 26 are opposite those in contact 28, when contact 26 and 28 are disposed in a vacuum interrupter 16, face to face as shown in FIG. 1, they tend to move the arc in the same direction.

Contacts 26 and 28 are positioned so that the slotted lip portions 50 of contact 26 and 28 face each other and are constructed to produce an unbalance in the magnetic field distribution and therefore a large magnetic force to drive the arc in a specified predetermined direction.

The current path through contact 28 is up the contact wall 48 through one of the surfaces 50 to the annular cap 46 into the arc 54. During circuit interruption when an arc 54 is formed between contacts 26 and 28 the arc is driven radially inward and rotates rapidly around the inner periphery 58 of the annular cap 46 until the arc 54 is extinguished, which occurs on an alternating current cycle at approximately the first current zero. Because of the cuts in the lip portion 47 and the wall 48 the current flows in a manner to create magnetic forces that cause the arc to run around the base or innersurface of annular cap 46.

The advantages of the cup-shaped construction with a continuous annular contact surface, are numerous such as: (1) Melting of the contact materials is avoided at low to medium current and therefore anode spot formation is prevented up to relatively high current; (2) The arc is bowed radially inward and thus prevented from inneracting and burning the vapor shield 40; (3) A smaller size interrupter can be built for a given current rating than is possible with other types of contacts; (4) Increase current and voltage rating can be obtained in existing models without expensive preconditioning or seasoning.

The cap 46 which is formed of an appropriate contact material is fused, welded, brazed or otherwise attached to the lip 47 of contact 28. Cap 46 is constructed to fit over the entire surface 47 of the contact 28. Both mating contacts 26 and 28 are fitted with a similar cap 46. Thus, arcing will take place between smooth surfaces on cap 46 and the arc roots will not have to jump over gaps in the surface; nor can the arc become hung up on sharp edges or point locations in a manner so as to produce an unwanted anode spot. Additionally the thickness of the cap is made small relative to the thickness of the lip portion 47 so the current flow path in the various segments 50 of the lip 47 and in the walls 48 of the cup are substantially uneffected by the presence of the cap 46 thus providing all desired beneficial magnetic forces and resulting arc motions. Other means to accomplish the ideas put forth in this disclosure will be evident to those skilled in the art of metal forming. As an example, the contact can be first made with the slots cut entirely through the surface. The slots on the face of the rim or arcing surface are then closed over by mechanical peening. The whole arching surface can then be fused over, perhaps in a vacuum, by the application of intense localized heating supplied from arc welding apparatus, high powered electron beams, high powered laser beams, or the like. The result is to form a contact having all the contact features attribute to the contact shown in FIG. 4 but made from one piece of contact material.

The disclosed contact provides superior current and voltage performance which will be available in a vacuum interrupter for the first high current operation, without lengthy arc-seasoning or conditioning.

What is claimed is:

1. A vacuum type circuit interrupter comprising:

a pair of relatively movable contacts, movable between a closed position in engagement and an open position spaced apart to form an arcing gap therebetween across which an arc can form during circuit interruption;

a housing which is evacuated surrounding said pair of contacts;

at least one of said contacts comprising a flat round base portion; a circular side wall portion extending perpendicular from said flat round base portion; a lip portion extending radially inward from the top of said circular side wall portion; said side wall portion and said lip portion having slots formed therein; and an annular contact cap, having no slots formed therein is disposed on said lip portion, said annular contact cap extends radially outward to the outer diameter of said circular side wall portion and radially inward beyond said slotted lip portion to form a smooth contact surface.

2. A vacuum type circuit interrupter as claimed in claim 1 wherein:

said annular contact cap is relatively thinner than said lip portion; and, the inner diameter of said annular contact cap is formed into an arcing ring which extends downward along the inner diameter of said lip portion.

3. A vacuum type circuit interrupter as claimed in claim 1 wherein:

said flat round base portion, said side wall portion, and said lip portion, are formed from a material having good electrical conductivity properties;

said annular contact cap is formed from material having good arc interrupting properties;

said annular contact cap is relatively thinner than said lip portion; and, the inner diameter of said annular contact cap is formed into a smooth arcing ring which extends downward along the inner diameter of said lip portion.

4. A vacuum interrupter as claimed in claim 1 wherein:

said base portion, said side wall portion, and said lip portion, are formed from copper; and, said annular contact cap is formed from chromium-copper material.

5. The vacuum interrupter as claimed in claim 1, wherein the interrupter is operable at a rating of up to 50KA and 38KV.

* * * * *